US011242661B2

(12) United States Patent
Mitchell

(10) Patent No.: US 11,242,661 B2
(45) Date of Patent: Feb. 8, 2022

(54) DEVICES AND METHODS FOR COLLECTING WASTE

(71) Applicant: Earl C. Mitchell, Suwanee, GA (US)

(72) Inventor: Earl C. Mitchell, Suwanee, GA (US)

(73) Assignee: Earl C. Mitchell, Suwanee, GA (US)

( * ) Notice: Subject to any disclaimer, the term of this patent is extended or adjusted under 35 U.S.C. 154(b) by 92 days.

(21) Appl. No.: 16/744,692

(22) Filed: Jan. 16, 2020

(65) Prior Publication Data

US 2020/0232175 A1 Jul. 23, 2020

Related U.S. Application Data

(60) Provisional application No. 62/793,885, filed on Jan. 17, 2019.

(51) Int. Cl.
*E01H 1/12* (2006.01)

(52) U.S. Cl.
CPC ... *E01H 1/1206* (2013.01); *E01H 2001/1293* (2013.01)

(58) Field of Classification Search
CPC ..... E01H 1/1206; E01H 2001/1293; E01H 2001/1246
See application file for complete search history.

(56) References Cited

U.S. PATENT DOCUMENTS

| | | | | |
|---|---|---|---|---|
| 3,802,728 | A | 4/1974 | Giacopelli | |
| 3,901,544 | A | 8/1975 | Tucciarone | |
| 4,058,337 | A | 11/1977 | Isac | |
| 4,119,337 | A | 10/1978 | Sherhandt | |
| 4,536,023 | A * | 8/1985 | Sutter | F23J 1/04 126/242 |
| 4,741,566 | A * | 5/1988 | Byung-Do | A01K 23/005 15/104.8 |
| 4,776,621 | A | 10/1988 | Streit | |
| 4,966,400 | A | 10/1990 | Hull et al. | |
| 5,624,144 | A * | 4/1997 | Roche | E01H 1/1206 294/1.3 |
| 5,667,264 | A * | 9/1997 | Tanahara | E01H 1/1206 15/257.6 |
| 7,900,644 | B2 * | 3/2011 | McGee | E01H 1/1206 135/66 |
| 2013/0140220 | A1 * | 6/2013 | Knittel | A01K 1/01 209/419 |

* cited by examiner

*Primary Examiner* — Stephen A Vu
(74) *Attorney, Agent, or Firm* — Troutman Pepper Hamilton Sanders LLP; Korbin Blunck; Haden Marrs

(57) ABSTRACT

The disclosed technology includes a device for collecting animal waste. The device can comprise a collection portion, an inner shaft, and a rotating blade assembly configured to rotate a blade to collect the waste into the collection portion. The inner shaft can be affixed to the collection portion such that the waste collector can remain upright without the assistance of the user. Furthermore, the collection portion can be configured to retain collected waste until the waste is emptied. The blade can be modified to collect different types of waste on various surfaces.

19 Claims, 6 Drawing Sheets

DEVICES AND METHODS FOR COLLECTING WASTE

CROSS-REFERENCE TO RELATED APPLICATIONS

This application claims the benefit under 35 U.S.C. § 119(e) of U.S. Provisional Patent Application No. 62/793,885, filed 17 Jan. 2019, the entire contents and substance of which are incorporated herein by reference in their entirety.

FIELD OF TECHNOLOGY

The present disclosure relates generally to improved devices and methods for collecting waste, and more specifically, an improved waste collector having a rotational blade and a collection bin.

BACKGROUND

Pet owners are familiar with the common problem of picking up waste after a pet defecates. Animal waste can emit a foul odor, create an unpleasant mess, and even be a health hazard to humans. In many locations, pet owners are required by city ordinances to remove waste left behind by their pets. Removing animal waste typically involves using either a plastic bag or a shovel to collect the waste and dispose of it.

A common removal method involves the owner placing his or her hand inside a bag, bending over to collect the waste in their bag-covered hand, and then turning the bag inside-out to capture the waste. This process can be repulsive as the owner can feel the waste through the bag. Further, owners are limited to collecting small piles of waste as owners are generally unable to reuse the bag to collect additional waste.

Another common removal method involves the owner using a shovel. The owner can typically bend over with the shovel to collect the waste and then empty the shovel into a waste collector. This process can be rather arduous as shovels are typically not suited for carrying around and usually have an angled blade that causes the waste to fall out if the shovel is set aside prior to emptying the collected waste, which means owners must collect and empty waste before moving on to other tasks. Further, because using a shovel requires the owner to bend over, such use can lead to back pain.

Other devices for collecting animal waste have been developed over the years to help alleviate pet owners of the often-arduous task of collecting their pet's waste. These devices include spade and scoop sets, scoops with jaws that open and close, robotic waste collectors, and even vacuum waste collectors. However, these devices are either too expensive for the average pet owner, unable to collect more than one pile of waste at a time, unable to be set aside without first emptying the collector, or require more than one hand to operate. These and other problems can be addressed by the technology disclosed herein.

BRIEF SUMMARY

The disclosed technology includes a device for collecting waste.

The waste collection device can have a collection portion, an inner shaft that is attached to the collection portion, an outer shaft that is slidably and rotatably attached to the inner shaft, and a blade attached to the outer shaft. Alternatively, the waste collection device can also have a handle extension attached to the outer shaft by an adjustable mechanism. The adjustable mechanism can adjust a distance between the bottom end of the outer shaft and the top end of the handle extension. A handle can also be attached to the handle extension.

The waste collector can also have a blade that alternatively can have a substantially crescent shape. The blade can have a body portion and a sweeping portion. The sweeping portion can comprise a plurality of gaps in the body portion or the sweeping portion can be one or more sweeping members affixed to the body portion. The sweeping portion can also have a tapered and a canted edge.

The collection portion can have a collecting plate, a lip extending from a portion of the collecting plate, a foot-hold extension, and a handle. The collection portion can also be configured to support a bag, bucket, box, or other container.

The waste collector can also have an electric motor configured to rotate the blade.

The waste collector can alternatively have a collection portion, an inner shaft with a first end and a second end and attached to the collection portion at its first end. The waste collector can also have an outer shaft attached with a first end and a second end and attached to the inner shaft such that the outer shaft can slide axially and rotate circumferentially with respect to the inner shaft. Additionally, the waste collector can have a handle extension with a first end and a second end and attached to the outer shaft's second end by an adjustment mechanism configured to adjust a distance between the outer shaft's first end and the handle extension's second end. The waste collector can also have a blade attached to the outer surface of the outer shaft and proximate to the first end of the outer shaft. The waste collector can also have a handle attached to the send end of the handle extension.

Alternatively, the waste collector can have a blade that is a substantially crescent shape. Alternatively, the waste collector can have a blade that is a broom or a rake.

The waste collector can also have a collection portion which has a collecting plate, a lip extending upwards from a portion of the collecting plate, a foot-hold extension, and a handle. Alternatively, the collection portion can comprise a rounded collecting plate. The collection portion can also be configured to support a bag, a bucket, or a box.

Alternatively, the waste collector can also have an electric motor configured to rotate the blade.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
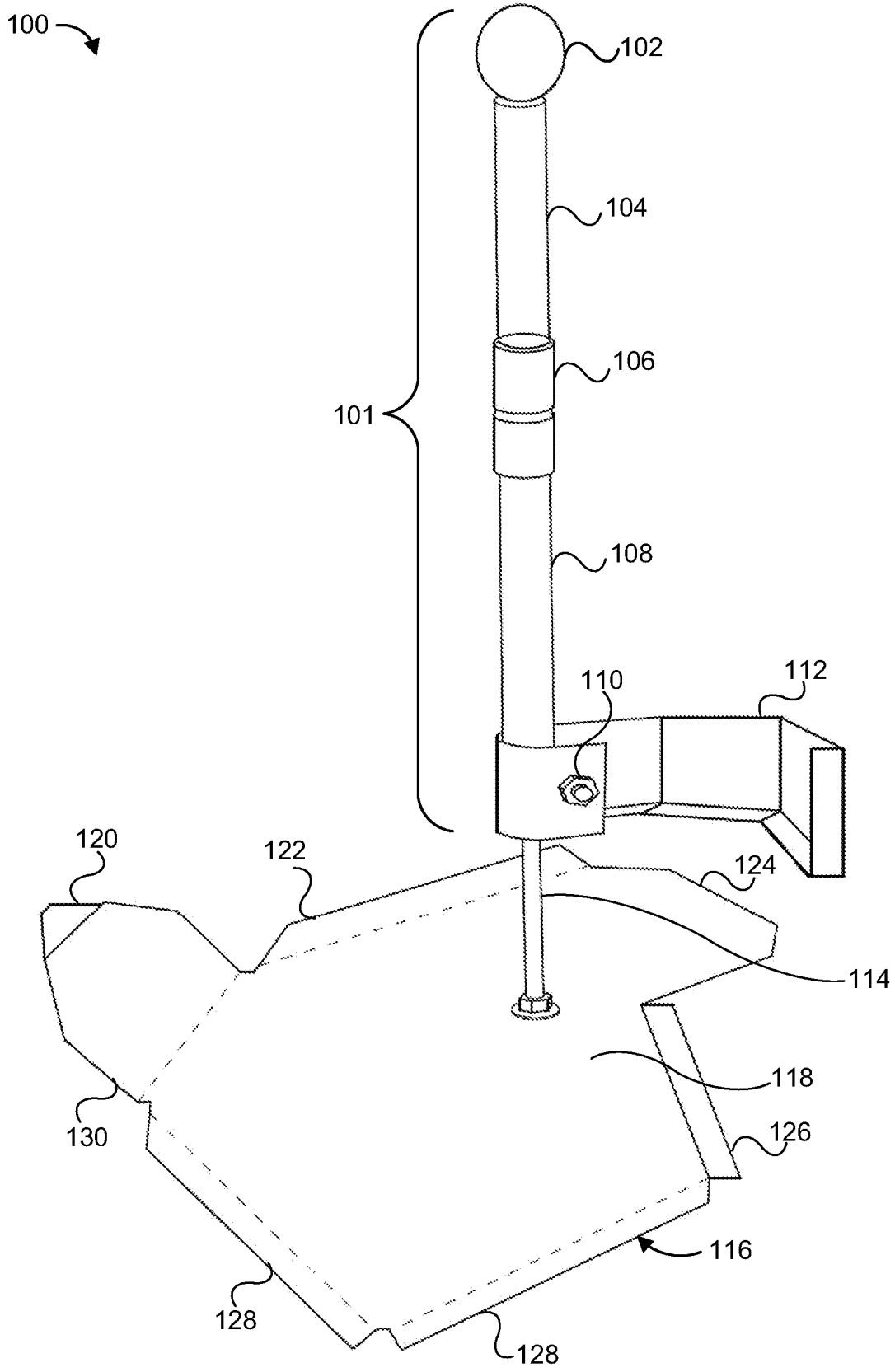
FIG. 1 is a schematic view of a device for collecting waste.

The disclosed technology relates to improved devices for collecting waste. The device can have a collection portion, an inner shaft, and a rotating handle with a blade attached near its bottom end to direct waste into the collection portion. The device can make it easier for a user to collect and dispose of waste. The user can collect the waste by simply placing the collection portion near the waste and rotating the handle, and consequently the blade, to direct the waste into the collection portion.

Although certain examples of the disclosed technology are explained in detail with regard to the collection of animal waste, it is to be understood that other examples, embodiments, and implementations of the disclosed technology are contemplated such as, for example, the collection of other types of waste (e.g., food, trash, plant, etc.). Accordingly, it is not intended that the disclosed technology is limited in its scope to the details of construction and arrangement of components set forth in the following description or illustrated in the drawings. The disclosed technology is capable of other embodiments and of being practiced or carried out in various ways. Also, in describing the many examples, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named. Also, in describing the examples, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the various examples of the disclosed technology includes from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required. Further, the disclosed technology does not necessarily require all steps included in the example methods and processes described herein. That is, the disclosed technology includes methods that omit one or more steps expressly discussed with respect to the examples provided herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

To facilitate an understanding of the principles and features of the disclosed technology, various illustrative examples are explained below. In particular, the presently disclosed subject matter is described in the context of being a device for collecting animal waste. The present disclosure, however, is not so limited, and can be applicable in other contexts. For example, and not limitation, the present disclosure can have other applications, including collection of spilled foods, garbage collection, leaf collection, industrial waste collection, and many other applications where a user would want to collect objects from the ground or a generally flat surface. Such implementations and applications are contemplated within the scope of the present disclosure. Accordingly, when the present disclosure is described in the context of a device for collecting animal waste, it will be understood that other implementations can take the place of those referred to.

Referring now to the drawings, in which like numerals represent like elements, examples of the present disclosure are herein described.

As shown in FIG. 1, the waste collector 100 can comprise a rotating blade assembly 101, an inner shaft 114, and a collection portion 116. As depicted, the inner shaft 114 can be attached to the collection portion 116 and the rotating blade assembly 101 can be attached to the inner shaft 114 such that as a portion of the rotating blade assembly 101 rotates any waste in the path of rotation can be moved into the collection portion 116. The rotating blade assembly 101 can comprise a handle 102, a handle extension 104, a handle length adjustment mechanism 106, an outer shaft 108, and a blade 112. As shown, the blade 112 can be attached to the outer shaft 108 near a bottom end of the outer shaft 108, which can be mounted to slide axially and rotate circumferentially with respect to the inner shaft 114. Because the outer shaft 108 can be mounted to slide axially and rotate circumferentially with respect to the inner shaft 114, the entire blade assembly 101 can be lifted and rotated to turn the attached blade 112 such that the blade 112 can move waste onto the collection portion 116.

The blade 112 can be connected to the outer shaft 108 near the outer shaft's 108 bottom end. By connecting the blade 112 near the outer shaft's 108 bottom end, the blade 112 can be positioned by the rotating blade assembly 101 to best scoop the waste onto the collecting plate when in operation. The blade 112 can be removably-attached to the outer shaft 108 by using a fastener 110 that clamps a portion of the blade 112 around the outer shaft 108. Alternatively, the blade 112 can be removably-attached to the outer shaft 108 by using a twistable locking mechanism, a push and release locking mechanism, a press fit, a threaded connection, spring-loaded clamps, cable ties, or any other suitable connection. If the blade 112 is removably-attached to the outer shaft 108, the blade 112 can be made to be interchangeable with different types of blades 112 to be used in different applications. Alternatively, the blade 112 can be permanently attached to the outer shaft 108 by a weld, adhesives, or even machining or forming the outer shaft 108 to have a blade 112 permanently attached.

Figure 2A:
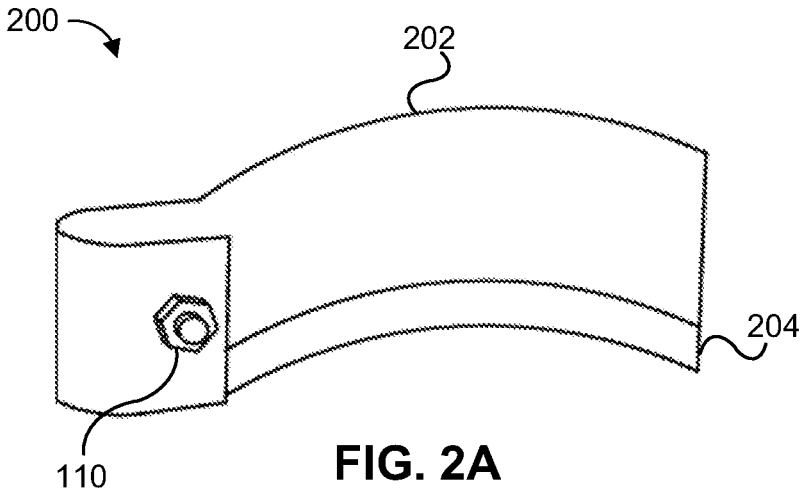
FIG. 2A is a schematic view of a curved blade according to one example of the disclosed technology.
Figure 2B:
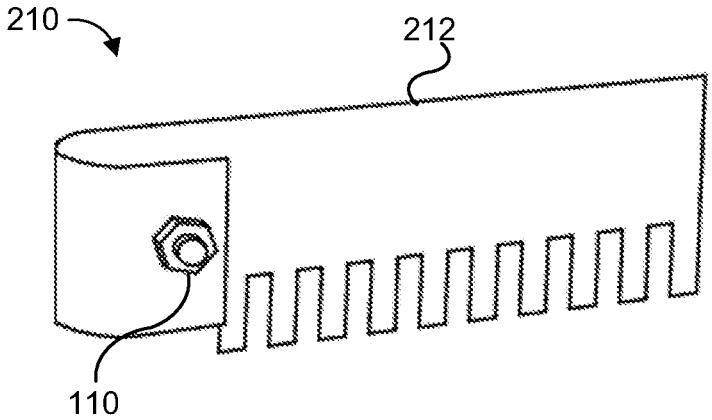
FIG. 2B is a schematic view of a rake-type blade according to one example of the disclosed technology.
Figure 2C:
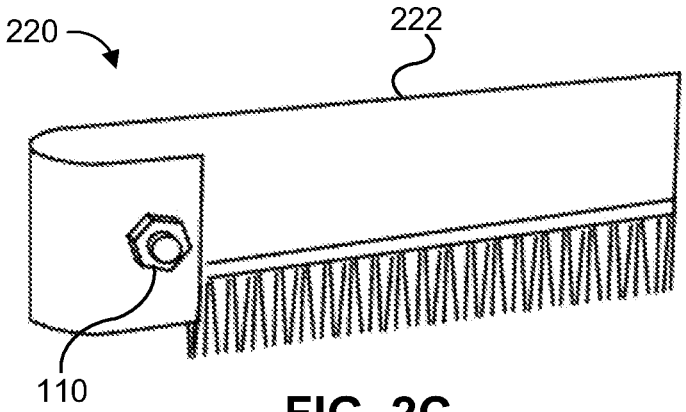
FIG. 2C is a schematic view of a sweep-type blade according to one example of the disclosed technology.
Figure 3:
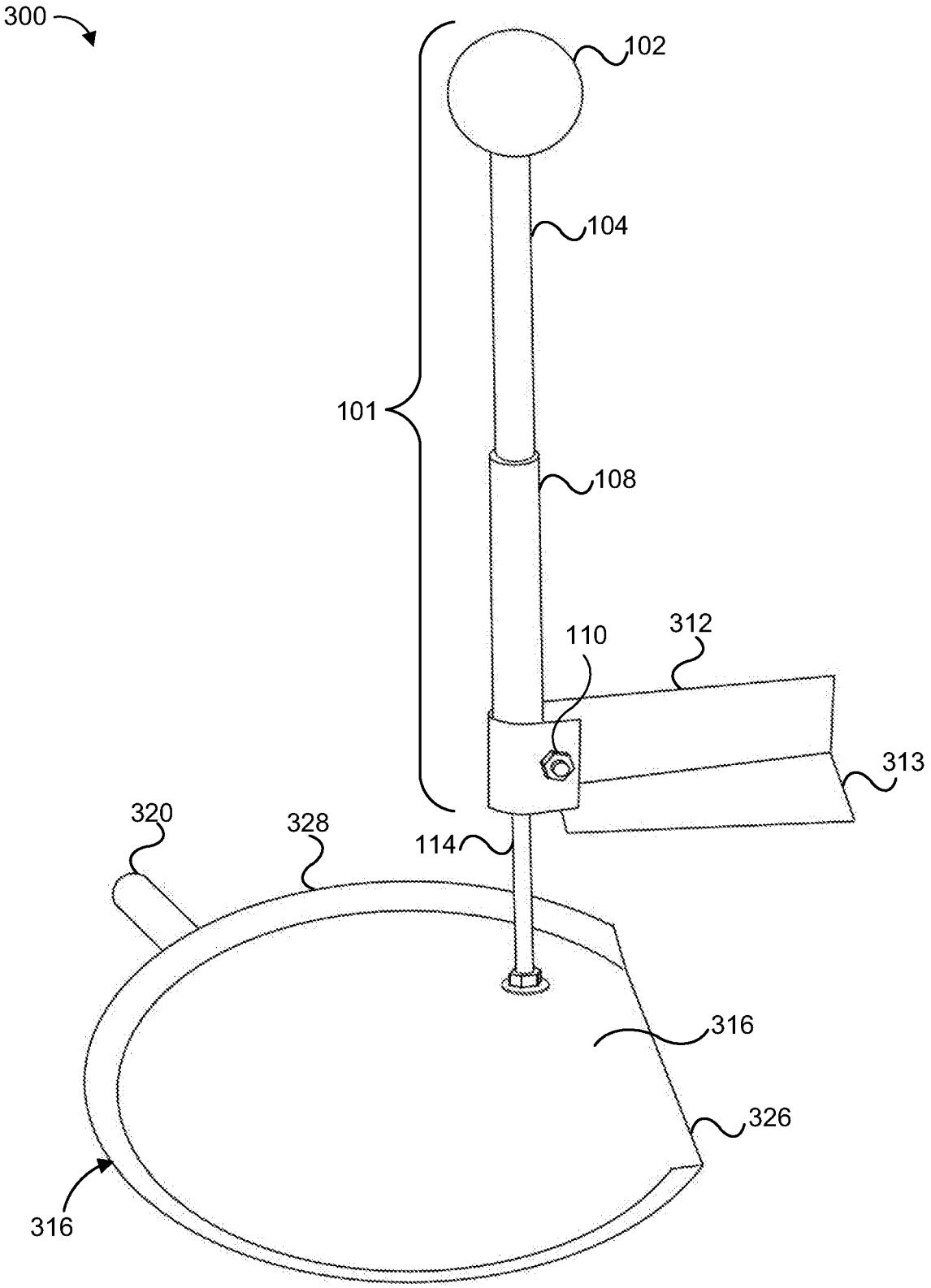
FIG. 3 is a schematic view of a device for collecting waste having a rounded collecting plate and a tapered and canted blade edge.

The blade 112 can be designed to suit many different applications and can be made of any material suitable for the application. For example and not limitation, the blade 112 can be made of metal, plastic, rubber, wood, ceramics, or any other combination of suitable materials. Furthermore, the blade 112 can comprise various shapes suited for the application. For example, as shown in FIG. 1, the blade 112 can have multiple flat surfaces connected at angles, to create a substantially crescent shape, to better collect and scoop waste onto the collecting plate. The blade 112 can be made of sheet metal and cut and bent to take the shape depicted in FIG. 1. Although not shown, the blade 112 can optionally have a rubber sweep attached to the bottom surface to help collect waste and protect the collection portion 116 and blade 112 from wear during use. Other examples of the blade 112 can be seen in FIGS. 2A-2C. As shown in FIG. 2A, the blade 112 can be a curved blade 202 that has a flexible edge 204. FIG. 2B shows a blade 112 that is a rake-type blade 212 that has teeth like a rake that can help to collect waste from a rough or loose surface, like grass, sand, or dirt. FIG. 2C shows a brush-type blade 222 that has bristles like a brush to help collect waste from firm surfaces like cement, asphalt, tile, wood floors, or a table. Alternatively, the blade 112, as shown in FIG. 3, can be a straight blade 302 having a bottom portion that is a canted and tapered blade edge 304. The canted and tapered edge 304 can help the blade 112 to collect waste onto the collection portion 116 across the entire length of the blade 112. As one of skill will appreciate, the blade 112 can be modified for various applications and is not limited to the various designs shown in the figures.

The rotating blade assembly 101, as depicted in FIG. 1, can be made to be adjustable in length by having a handle extension 104 attached to the outer shaft 108 by a handle length adjustment mechanism 106. The handle length adjustment mechanism 106 can be any mechanism designed to adjustably connect the handle extension 104 to the outer shaft 108, including removeable fasteners or spring-loaded pins inserted into pre-drilled holes, a twistable locking mechanism, a telescoping handle that is friction fit to lock into place, a quick-release clamp, or a simple clamp. Furthermore, the rotating blade assembly 101 can comprise multiple handle extensions 104 and handle length adjustment mechanisms 106 so that the waste collector 100 can collapse into a portable position. On the other hand, although the waste collector depicted in FIG. 1 shows a rotating blade assembly 101 comprising a handle 102, a handle extension 104, a handle adjustment mechanism 106, and a outer shaft 108, the waste collector 100 can be made with only the outer shaft 108. If the rotating blade assembly 101 only comprises an outer shaft 108, the waste collector 100 could be operated by gripping the outer shaft 108 to rotate the blade 112. A rotating blade assembly 101 that only comprises a outer shaft 108 can be more economical to manufacture but would lack the ability to adjust in length and may not be as comfortable for the user to operate.

The handle extension 104 can be round, rectangular, a triangular, or any other suitable cross-sectional shape for the application. The handle extension 104 can be a solid piece of material or can be hollow tube to reduce weight. Furthermore, the handle extension 104 can be made of any suitable material, including but not limited to, plastic, metal, composite material, or wood.

The outer shaft 108 can be round, rectangular, triangular, or any other suitable cross-sectional shape for the application. Furthermore, the outer shaft, 108 can be a hollowed tube to allow for the outer shaft 108 to be mounted to slide axially and rotate circumferentially with respect to the inner shaft 114 and to receive the handle extension 104. The outer shaft 108 can have a built-in restriction in the center that restricts the outer shaft 108 from sliding completely off the inner shaft 114. The built-in restriction can be, for example, a bushing retainer, a fastener, a welded restriction, or even a portion of the outer shaft 108 which has been machined to have a restriction. Furthermore, the outer shaft 108 can be made of any suitable material, including but not limited to, plastic, metal, composite material, or wood.

As discussed, the rotating blade assembly 101 can have a handle 102 attached to the handle extension 104. The handle 102 can be mounted on the top end of the handle extension to provide a more pleasing experience for the user than simply gripping the handle extension 104 or outer shaft 108 alone. Although shown as a mostly spherical shape, the handle 102 can be any shape to allow the user to grip the handle 102 and operate the rotating blade assembly 101. For example, the handle 102 can be designed to be an ergonomic shape, like the spherical shape depicted in FIG. 1, or another shape intended to conform to the palm and fingers of a user. Furthermore, although the handle is shown as mounted on the top end of the handle extension 104, the handle 104 can be mounted near the top end and positioned to the side of the handle extension 104 to help provide a greater moment arm to the blade 112 when operated. The handle 102 can be made of any suitable material, including but not limited to, plastic, rubber, wood, metal, composite material, or ceramic material.

The inner shaft 114 can be designed to allow the outer shaft 108 to be mounted to slide axially and rotate circumferentially with respect to the inner shaft 114. To allow for the outer shaft 108 to both slide and rotate but still be connected to the inner shaft 114, the inner shaft 114 can simply be a threaded shaft with a nut and washer at the end to keep the outer shaft 108 from sliding completely off of the inner shaft 114. Alternatively, the inner shaft 114 can be a rod with a plate welded to the end, a rod with a machined-out circumference, or any other suitable shape that can allow the outer shaft 108 to slide along and rotate around the inner shaft 114 without completely detaching.

The inner shaft 114 can be attached to the collection portion 116 by any suitable connection to keep the inner shaft 114 attached to the collection portion 116. For example, and not limitation, the inner shaft 114 can be attached to the collection portion 116 by a welded joint, a fastener, a threaded fitting, a press fit, a brazed connection, adhesives, or manufactured as one assembly such as in a mold. Furthermore, the inner shaft 114 can be attached to the collection portion 116 by a hinged connection to allow the rotating blade assembly 101 to be folded near the collection portion 116 for storage or transportation. If the inner shaft 114 is attached to the collection portion 116 by a hinged connection, the connection could comprise a self-locking hinge so that the user does not need to manually tighten the hinge to operate the waste collector 100. Alternatively, the inner shaft 114 can be attached to the collection portion 116 by a removable connection so that the inner shaft 114, and consequently the rotating blade assembly 101, can be completely removed from the collection portion 116.

Although depicted in FIG. 1 as a collection portion 116 comprising a flat collecting surface with modified edges to collect and empty the waste, the collection portion 116 can take many forms. For example, and not limitation, a collection portion 116 can have a flat collecting surface upon which the waste can be collected, such as the collection portion 116 depicted in FIG. 1 or the rounded collection portion 316 depicted in FIG. 3. Furthermore, the collection portion can be modified to make it easier to collect and empty the waste, such as having a bag, bucket, box, or other form of container attached to the collection portion so that the waste collected on the flat collecting surface can be easily disposed into a bag, bucket, box, or other form of container. Other examples of the collection portion 116 can comprise a collection portion without the need for a flat collecting surface, such as a collection portion comprising a bag, box, bucket, or other container held open by a support structure or bracket so that the waste can be directly collected into the bag, box, bucket, or other container rather than being first collected onto a flat collecting surface. One of skill in the art will appreciate that many modifications to the collection portion 116 could be made to make the collection and disposal of waste easier.

As a specific example, the collection portion 116, as depicted in FIG. 1, can have a collecting plate or base 118, a collecting plate handle 120, a lip 122, a foot hold extension 124, a receiving edge 126, canted edges 128, and an extended canted edge 130 to help collect waste and dispose of the collected waste. As one of skill will appreciate, the various features of the example collection portion 116 just described can all be made from a single piece of material or be multiple pieces of material attached to the collecting plate or base 118. For example, the collection portion 116 can be a single piece of sheet metal that is cut and bent to form the various features. As another example, the collection portion 116 can be made from a single piece of plastic or composite material that is formed in a mold. As yet another example, the collection portion 116 can have a collecting plate or base 118 made of metal and the various other features, either made of metal or another type of material, can be attached to the collecting plate.

The collecting plate or base 118 can be a substantially flat piece of material intended to hold the waste after it has been collected while also providing a support to hold the waste collector 100 upright. The collecting plate or base 118 can be made of any suitable material, including metal, plastic, composite material, or any combination of suitable materials. The collecting plate or base 118 can have rubber foot pads applied to the bottom surface to help stabilize the collection portion 116 when the user operates the waste collector 100 on smooth surfaces. The foot pads can also help to protect the work surface upon which the user places the waste collector 100.

The collecting plate handle 120 can help the user to grip the collection portion 116 when tipping the collecting plate or base 118 to empty collected waste or when carrying the waste collector 100. The collecting plate handle 120 can be a simple protrusion as shown in FIG. 1 or be an attached piece of material such as a rubber or plastic attachment affixed to the extended canted edge 130. The collecting plate handle 120 can be an ergonomic shape to be easier to operate and can be made of plastic, rubber, wood, metal, ceramic materials, composite materials, or any other suitable material or combination of materials for the application.

The lip 122 can help maintain collected waste on the collection portion 116, provide a location where a user can press his or her foot against to help guide the receiving edge 126 near the waste intended to be collected, and act as a stop to prevent the blade 112 from rotating too far and pushing the waste off the collection portion 116. As discussed earlier, the lip 122 can be formed by bending the collecting plate or base 118 to form the lip 122, be formed as part of the collecting plate or base 118 in a mold, or be a separate piece attached to the collecting plate or base 118 after manufacturing the collecting plate or base 118. The lip 122 can be made from plastic, wood, metal, ceramic materials, composite materials, or any other suitable material for the application.

The collection portion 116 can have a foot hold extension 124 upon which a user may place his or her foot to help keep the collection portion 116 in place while actuating the rotating blade assembly 101. The foot hold extension 124 can be a part of the collecting plate or base 118 or it can be attached to the collecting plate or base 118 after manufacturing the collecting plate or base 118. The foot hold extension 124 can include a rubber traction pad or a textured surface to provide additional traction for a user. Alternatively, the foot hold extension 124 can be attached to the collecting plate or base 118 by a hinged connection and be spring-loaded so that a user can push down on the foot hold extension 124 when needed and the foot hold extension 124 will spring back to an upright position to help contain the waste when no longer used. The foot hold extension 124 can be made from plastic, wood, metal, ceramic materials, composite materials, or any other suitable material for the application.

The receiving edge 126 can be a part of the collecting plate or base 118 that is bent slightly downward to assist in directing the waste onto the collection portion 116 when the blade 112 pushes the waste onto the collection portion 116. Alternatively, the receiving edge 126 can be an additional piece attached to the collecting plate or base 118 to help collect the waste. The receiving edge 126 can alternatively have a raised lip where the receiving edge 126 meets the collecting plate or base 118 to help ensure the collected waste remains on the collection portion 116. The receiving edge 126 can be made from plastic, wood, metal, ceramic materials, composite materials, or any other suitable material for the application.

The canted edges 128 can be edges that are part of the collecting plate or base 118 and bent slightly upwards to help keep waste on the collection portion 116 after the waste has been collected. The canted edges 128 can be a bent portion of the collecting plate or base 118 or be individual pieces of material attached to the collecting plate or base 118. The canted edges 128 can be made from plastic, wood, metal, ceramic materials, composite materials, or any other suitable material for the application.

The extended canted edge 130 can help keep waste on the collection portion 116, like the canted edges 128, while also acting as a portion of the collecting plate handle 120 to make emptying of the collection portion 116 easier. The extended canted edge 130 can be a bent portion of the collecting plate or base 118 or be an individual piece of material attached to the collecting plate or base 118. The extended canted edge 130 can be made from plastic, wood, metal, ceramic materials, composite materials, or any other suitable material for the application.

The waste collector 100 can be configured to be portable so that a user may take the waste collector 100 with them to walk their dog or on a road trip. Alternatively, the waste collector 100 can be configured to be mounted onto a vehicle, such as a lawn mower, golf cart, ATV, or other vehicle, to allow a user to collect waste while driving the vehicle.

FIG. 3 shows an alternate example of a waste collector 100 being a circular waste collector 300 and having the same elements as previously discussed except for a circular collection portion 316 and a straight blade 312 with a canted and tapered blade edge 313. For simplicity, it should be noted that the elements previously discussed for the waste collector 100 can perform the same functions and be made of the same materials as those previously discussed.

The alternate example of the circular waste collector 300 shown in FIG. 3 can have a handle extension 104 and outer shaft 108 connected together without the use of a handle length adjustment mechanism 106 as previously discussed. In this example, the handle extension 104 can be welded to the outer shaft 108 or can be telescopically-fitted inside the outer shaft 108 to allow the handle extension 104 to extend from the outer shaft 108 when using the waste collector 300. Alternatively, the handle extension 104 and outer shaft 108 can have a threaded connection or a mechanically-locking fitted connection.

The circular collection portion 316 can perform the same function of collecting waste as the collection portion 116 with a rounded contour. The circular collection portion 316 can have a circular collecting plate 318 that holds the collected waste. The circular collecting plate 318 can be made from plastic, wood, metal, ceramic materials, composite materials, or any other suitable material for the application.

The circular collection portion 316 can have a circular canted edge 328 that surrounds most of the circumference of the circular collection portion 316 except for the pan opening 326. Having a circular canted edge 328 can help to contain the collected waste on the circular collecting plate 318 much like the canted edges 128 previously discussed. The circular canted edge 328 can be made from plastic, wood, metal, ceramic materials, composite materials, or any other suitable material for the application. Furthermore, the circular canted edge 328 can be formed as part of the circular collecting plate 318 or be attached after manufacturing the circular collecting plate 318.

The circular collection portion 316 can have a pan handle 320 designed to perform the same or similar function as the collecting plate handle 120 to make it easier for a user to tip and empty the waste from the circular collecting plate assembly 316. The pan handle 320 can have an ergonomic shape to provide a more pleasing user experience and can be fixedly or removably attached to the circular collecting plate assembly 316. The pan handle 320 can be made from the same material as the rest of the circular collection portion 316 or can be an entirely separate material. For example, the pan handle 320 can be made from plastic, wood, metal, ceramic materials, composite materials, or any other suitable material for the application. Furthermore, the pan handle 320 can have a polymer or monomer coating to make it easier for a user to grip when emptying the waste from the circular collecting plate assembly 316.

Figure 4:
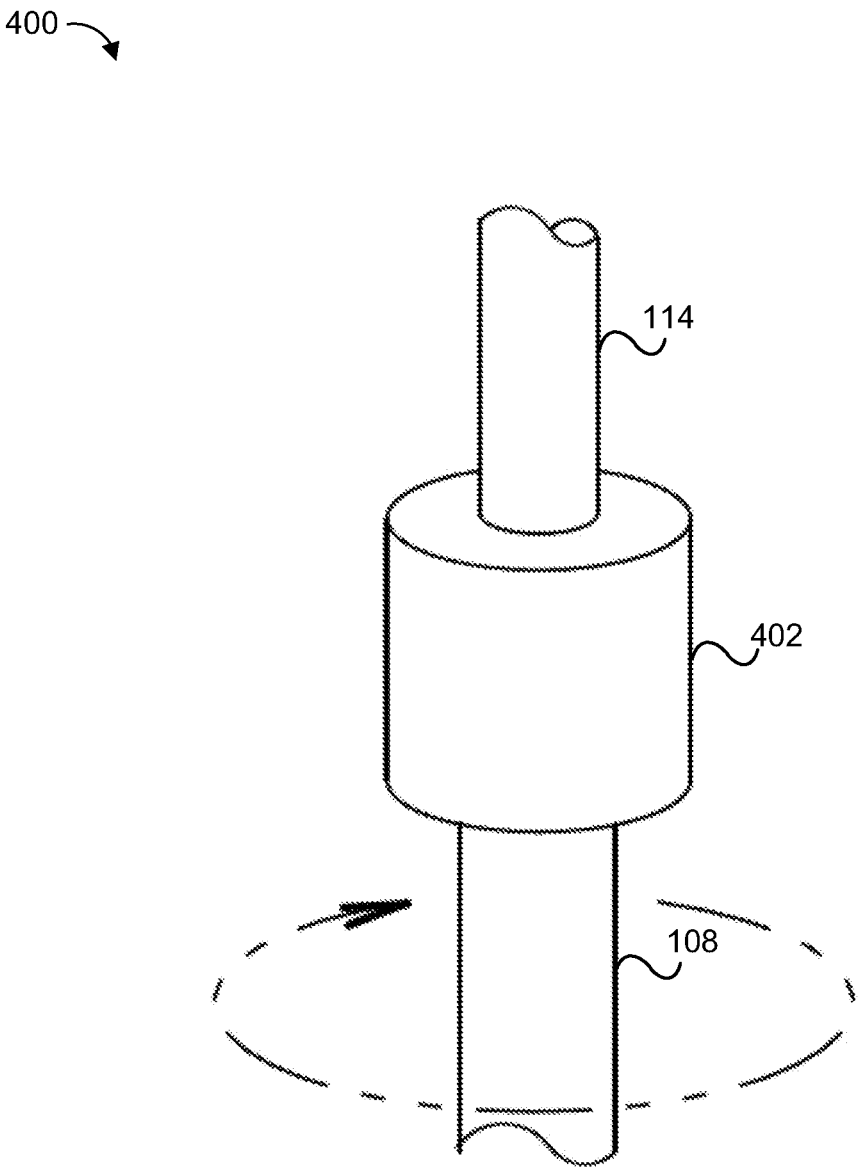
FIG. 4 is a schematic view of a motored rotation device according to one example of the disclosed technology.

FIG. 4 depicts one alternative example of a self-actuating waste collector 400 that can be modified to have a rotating blade assembly 101 that is actuated with an electric motor 402, rather than a user's hand. The self-actuating waste collector 400 can be a modified form of the waste collector 100 or circular waste collector 300, or any combination of the elements previously discussed. As will be appreciated, the self-actuating waste collector 400 can make it easier for a user to rotate the blade 112 and collect the waste onto the collection portion 116. The self-actuating waste collector 400 can have a motor mounted to rotate the outer shaft 108 in relation to the inner shaft 114 so that the blade 112 is rotated to collect the waste. Alternatively, the self-actuating waste collector 400 can have a motor mounted to rotate the blade 112 in relation to the outer shaft 108 or the inner shaft 114. The electric motor 402 can be battery operated and be either geared or not geared. The battery can be mounted on the electric motor 402, in the outer shaft 108, on the inner shaft 114, in the handle 102, or any other suitable location for the application. Furthermore, the electric motor 402 can be switched on by a button installed on the handle 102, a foot switch installed near the collecting plate or base 118, or a pressure sensitive switch installed so that a user can simply push down on the handle 102 to switch on the electric motor 402. The battery and switch can be electrically connected to the electric motor 402 by wires routed to complete the circuit. The electric motor 402 can be configured to rotate until a certain position (such as to a position on the collecting plate or base 118) and then retract to replace the blade 112 to its original position. As will be appreciated by one of skill in the art, the electric motor can be sized to have enough power to operate the blade 112 while still being light enough for a user to tote the waste collector 100 for the particular application.

Figure 5:
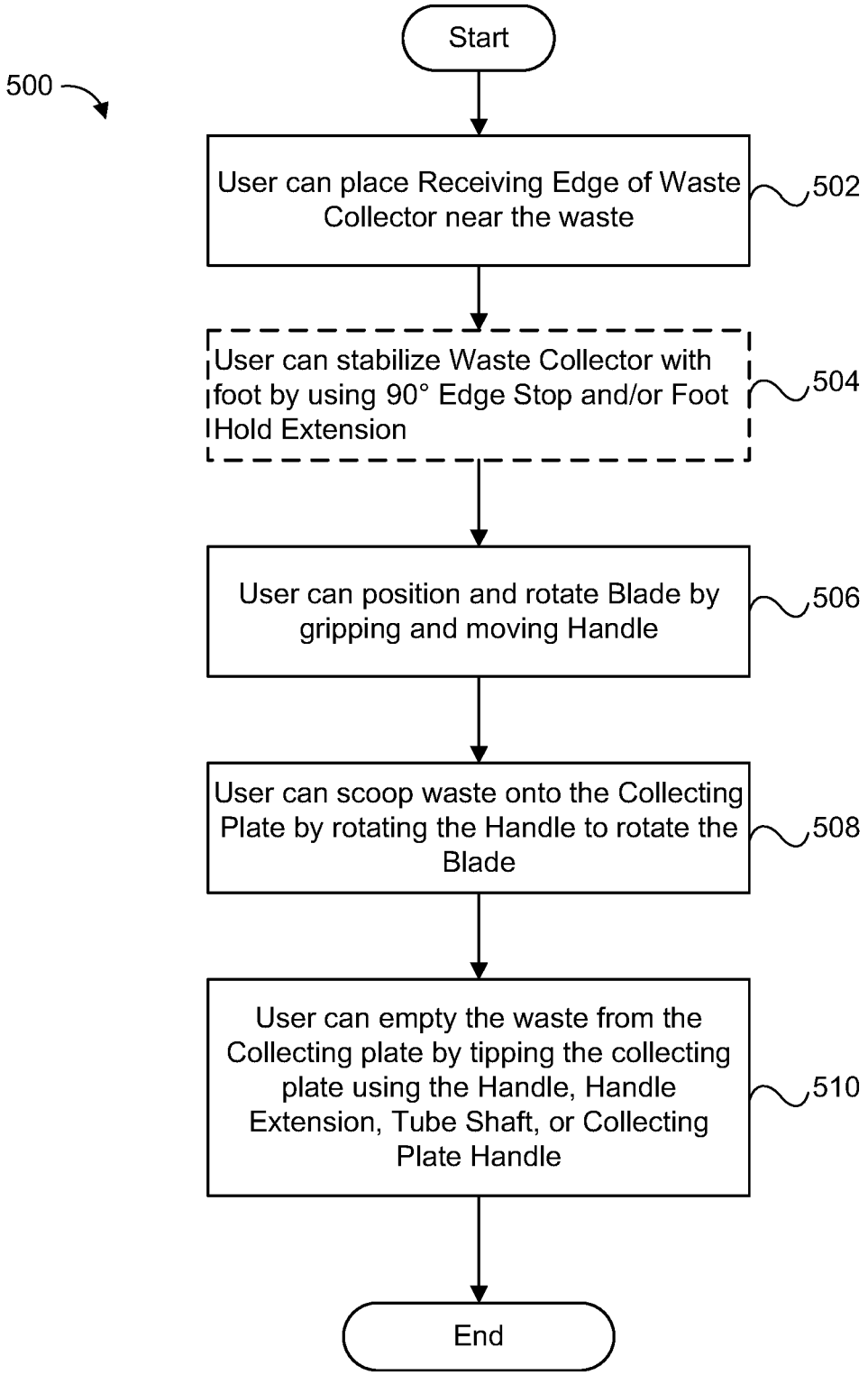
FIG. 5 depicts a method of collecting animal waste according to one example of the disclosed technology.

FIG. 5 depicts a method 500 of operating a waste collector 100. Although this method 500 is discussed in relation to the waste collector 100, one of skill will appreciate that this method 500 can also be used with the circular waste collector 300. Furthermore, this method 500 can be used with any modifications to the blade 112 as discussed herein. A user can begin by placing 502 the receiving edge 126 of the waste collector 100 near the waste. Optionally, the user can then stabilize 504 the waste collector 100 with his or her foot by placing his or her foot beside the 90° edge stop and/or placing his or her foot on the foot hold extension 124. The user can then position and rotate 506 the blade 112 by gripping and moving the handle 102. The user can then scoop 508 the waste onto the collecting plate or base 118 by rotating the handle 102 to rotate the blade 112. Once the waste is collected, the user can then empty 510 the waste from the collecting plate or base 118 by tipping the collecting plate or base 118. The user can tip the collecting plate or base 118 by using the handle 102, the handle extension 104, the outer shaft 108, or the collecting plate handle 120, or any combination thereof.

Figure 6:
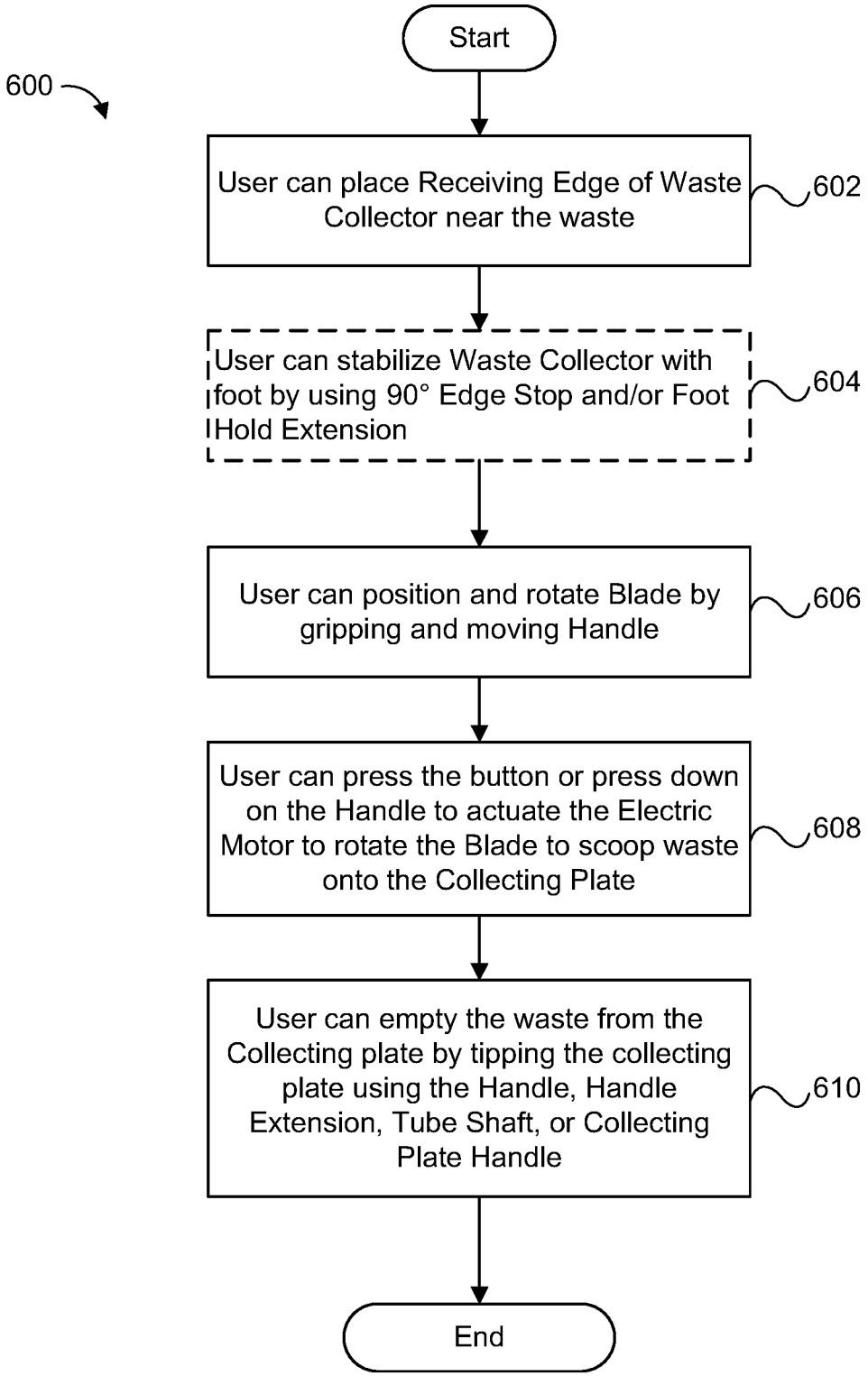
FIG. 6 depicts a method of collecting animal waste using a self-actuating waste collector according to one example of the disclosed technology.

FIG. 6 depicts a method 600 of operating a self-actuating waste collector 400. Although this method 600 is discussed in relation to the waste collector 100, one of skill will appreciate that this method 600 can also be used with the circular waste collector 300. Furthermore, this method 600 can be used with any modifications to the blade 112 as discussed herein. A user can begin by placing 602 the receiving edge 126 of the waste collector 100 near the waste. Optionally, the user can then stabilize 604 the waste collector 100 with his or her foot by placing his or her foot beside the 90° edge stop and/or placing his or her foot on the foot hold extension 124. The user can then position and rotate 606 the blade 112 by gripping and moving the handle 102. The user can then press 608 a button (or press down on the handle 102 if the waste collector 100 has a pressure sensitive switch) to actuate the electric motor 402, rotate the blade 112, and scoop the waste onto the collecting plate or base 118. Once the waste is collected, the user can then empty 610 the waste from the collecting plate or base 118 by tipping the collecting plate or base 118. The user can tip the collecting plate or base 118 by using the handle 102, the handle extension 104, the outer shaft 108, or the collecting plate handle 120, or any combination thereof.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

What is claimed is:

1. A waste collection device, the device comprising:

a collection portion comprising a collecting plate and a lip extending upwards from a portion of the collecting plate;

an inner shaft attached to the collection portion;

an outer shaft having a first end and a second end, wherein the outer shaft is slidably and rotatably attached to the inner shaft; and a blade attached proximate to the first end of the outer shaft, wherein the outer shaft is configured to circumferentially rotate about the inner shaft.

2. The device of claim 1, further comprising:

a handle extension having a top end and a bottom end, wherein the bottom end of the handle extension is attached proximate to the top end of the outer shaft by an adjustable mechanism, and wherein the adjustable mechanism is configured to adjust a distance between the bottom end of the outer shaft and the top end of the handle extension; and a handle affixed proximate to the top end of the handle extension.

3. The device of claim 1, wherein the blade comprises a substantially crescent shape.

4. The device of claim 1, wherein the blade comprises a body portion and a sweeping portion.

5. The device of claim 4, wherein the sweeping portion comprises a plurality of gaps in the body portion.

6. The device of claim 4, wherein the sweeping portion comprises a one or more sweeping members affixed to the body portion.

7. The device of claim 4, wherein the sweeping portion comprises a canted and tapered leading edge.

8. The device of claim 1, wherein the collection portion further comprises:

a foot-hold extension; and a handle.

9. The device of claim 1, wherein the collection portion is configured to support a removable container.

10. The device of claim 9, wherein the removable container is one of a bag, a bucket, or a box.

11. The device of claim 1, wherein the device further comprises an electric motor configured to rotate the blade.

12. A waste collector, comprising:

a collection portion;

an inner shaft having a first end and a second end, wherein the first end of the inner shaft is attached to the collection portion;

an outer shaft having a first end and a second end, wherein the outer shaft is attached to the inner shaft such that the outer shaft can slide axially and rotate circumferentially with respect to the inner shaft;

a handle extension having a first end and a second end, wherein first end of the handle extension is attached to the outer shaft proximate to the second end of the outer shaft by an adjustment mechanism, wherein the adjustment mechanism is configured to adjust a distance between the first end of the outer shaft and the second end of the handle extension;

a blade, wherein the blade is attached to the outer surface of the outer shaft and proximate to the first end of the outer shaft; and a handle affixed to the handle extension proximate the second end of the handle extension.

13. The waste collector of claim 12, wherein the blade comprises a substantially crescent shape.

14. The waste collector of claim 12, wherein the blade comprises a broom.

15. The waste collector of claim 12, wherein the blade comprises a rake.

16. The waste collector of claim 12, wherein the collection portion comprises:

a collecting plate;

a lip extending upwards from a portion of the collecting plate;

a foot-hold extension; and a handle.

17. The waste collector of claim 12, wherein the collection portion comprises a rounded collecting plate.

18. The waste collector of claim 12, wherein the collection portion is configured to support one of a bag, bucket, or box.

19. The waste collector of claim 12, wherein the waste collector further comprises an electric motor configured to rotate the blade.

* * * * *